US010252565B2

(12) United States Patent
Busam et al.

(10) Patent No.: US 10,252,565 B2
(45) Date of Patent: Apr. 9, 2019

(54) SHEET ITEM WITH NON-CIRCULAR HOLES

(71) Applicant: ACCO Brands Corporation, Lake Zurich, IL (US)

(72) Inventors: Edward P. Busam, Mason, OH (US); Bobby G. James, Jr., Miamisburg, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 0 days.

(21) Appl. No.: 14/969,355

(22) Filed: Dec. 15, 2015

(65) Prior Publication Data

US 2016/0167424 A1 Jun. 16, 2016

Related U.S. Application Data

(60) Provisional application No. 62/091,778, filed on Dec. 15, 2014.

(51) Int. Cl.

| | |
|---|---|
| ***B42F 3/00*** | (2006.01) |
| ***B42D 5/00*** | (2006.01) |
| *B42B 5/12* | (2006.01) |
| *B42F 13/16* | (2006.01) |

(52) U.S. Cl.

CPC ..... *B42F 3/006* (2013.01); *B42D 5/001* (2013.01); *B42F 3/003* (2013.01); *B42B 5/12* (2013.01); *B42F 13/16* (2013.01)

(58) Field of Classification Search

CPC ..... B42D 3/003; B42D 3/006; B42F 3/003; B42F 3/006

USPC ..... D19/32, 33

See application file for complete search history.

(56) References Cited

U.S. PATENT DOCUMENTS

| | | | | | |
|---|---|---|---|---|---|
| 1,797,900 | A | | 3/1931 | Cravitz | |
| D127,317 | S | | 5/1941 | Close | |
| 2,257,003 | A | * | 9/1941 | Farkas | B42F 3/003 281/27.2 |
| 3,107,673 | A | * | 10/1963 | Haddad | B42F 3/006 402/79 |
| 4,662,770 | A | * | 5/1987 | Block | B42F 3/006 402/79 |
| D309,155 | S | | 7/1990 | Hing | |
| D312,835 | S | | 12/1990 | Holm | |
| D318,068 | S | | 7/1991 | Truc | |
| D393,875 | S | | 4/1998 | Brooks | |
| 5,888,011 | A | * | 3/1999 | Reinbold, Jr. | B42F 3/003 402/70 |
| D418,867 | S | | 1/2000 | Platte | |
| D422,020 | S | | 3/2000 | Mochizuki | |
| 6,146,731 | A | | 11/2000 | Tanoto | |
| 6,168,340 | B1 | | 1/2001 | Lehmann et al. | |
| D450,346 | S | | 11/2001 | Hiller | |
| 6,431,780 | B2 | | 8/2002 | Moor et al. | |
| D493,830 | S | | 8/2004 | Castro | |
| D495,183 | S | | 8/2004 | Hassett | |

(Continued)

OTHER PUBLICATIONS

Google® search results screen shot (Nov. 24, 2015).

*Primary Examiner* — Kyle R Grabowski
(74) *Attorney, Agent, or Firm* — Thompson Hine LLP

(57) ABSTRACT

A sheet system including a sheet having an edge and at least one generally triangular hole positioned adjacent to but spaced apart from the edge. A side of the triangle is oriented generally parallel with the edge of the sheet.

22 Claims, 9 Drawing Sheets

(56) References Cited

U.S. PATENT DOCUMENTS

| | | | | |
|---|---|---|---|---|
| D634,782 | S | 3/2011 | Streem | |
| D640,318 | S | 6/2011 | Streem | |
| 7,997,106 | B2 | 8/2011 | Mahaffey et al. | |
| D751,841 | S | 3/2016 | Chang | |
| 2005/0204886 | A1 | 9/2005 | Lowenthal | |
| 2011/0057433 | A1* | 3/2011 | Savoy | B42B 5/10 281/27.2 |
| 2011/0233913 | A1 | 9/2011 | Wang | |
| 2011/0233914 | A1 | 9/2011 | Wang | |
| 2014/0191020 | A1 | 7/2014 | Busam | |

* cited by examiner

SHEET ITEM WITH NON-CIRCULAR HOLES

This application claims priority to U.S. provisional patent application Ser. No. 62/091,778 entitled SHEET ITEM WITH NON-CIRCULAR HOLES and filed on Dec. 15, 2014. The entire contents of that application are hereby incorporated by reference.

BACKGROUND

Sheet items, such as papers and the like, often include holes to bind the sheet item to a binding. However, many existing sheets items are prone to being torn along the holes when external forces are applied to the sheet item and/or binding.

SUMMARY

In one embodiment, the present invention is a sheet item including one or more holes which are shaped and/or configured to resist tearing. More particularly, in one embodiment the invention is a sheet system including a sheet having an edge and at least one generally triangular hole positioned adjacent to but spaced apart from the edge. A side of the triangle is oriented generally parallel with the edge of the sheet.

Other objectives, advantages and features of the system disclosed herein will become apparent from the following detailed description.

DETAILED DESCRIPTION

Figure 1:
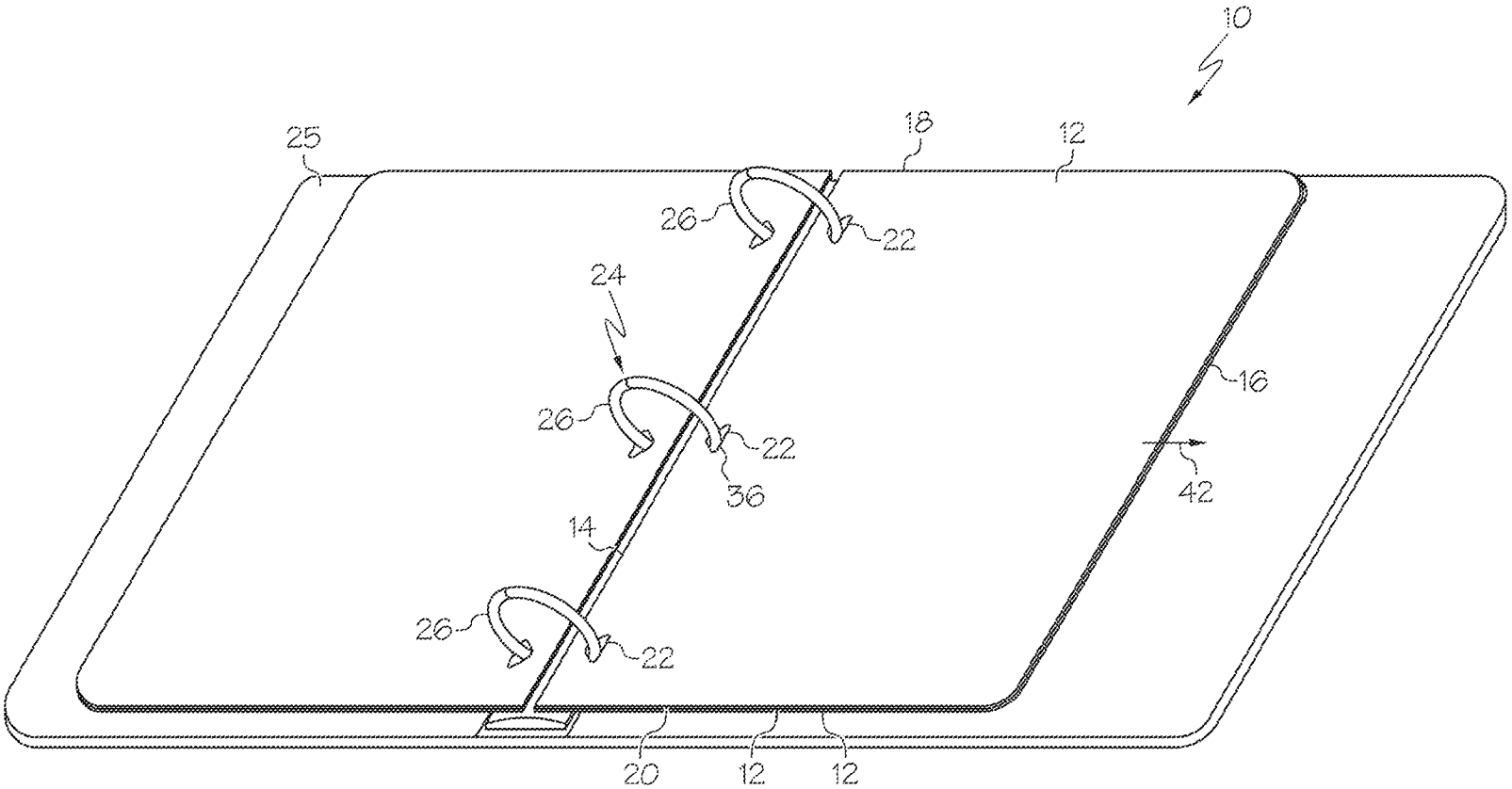
FIG. 1 is a top perspective view of a plurality of sheet items coupled to a three ring binding.
Figure 2:
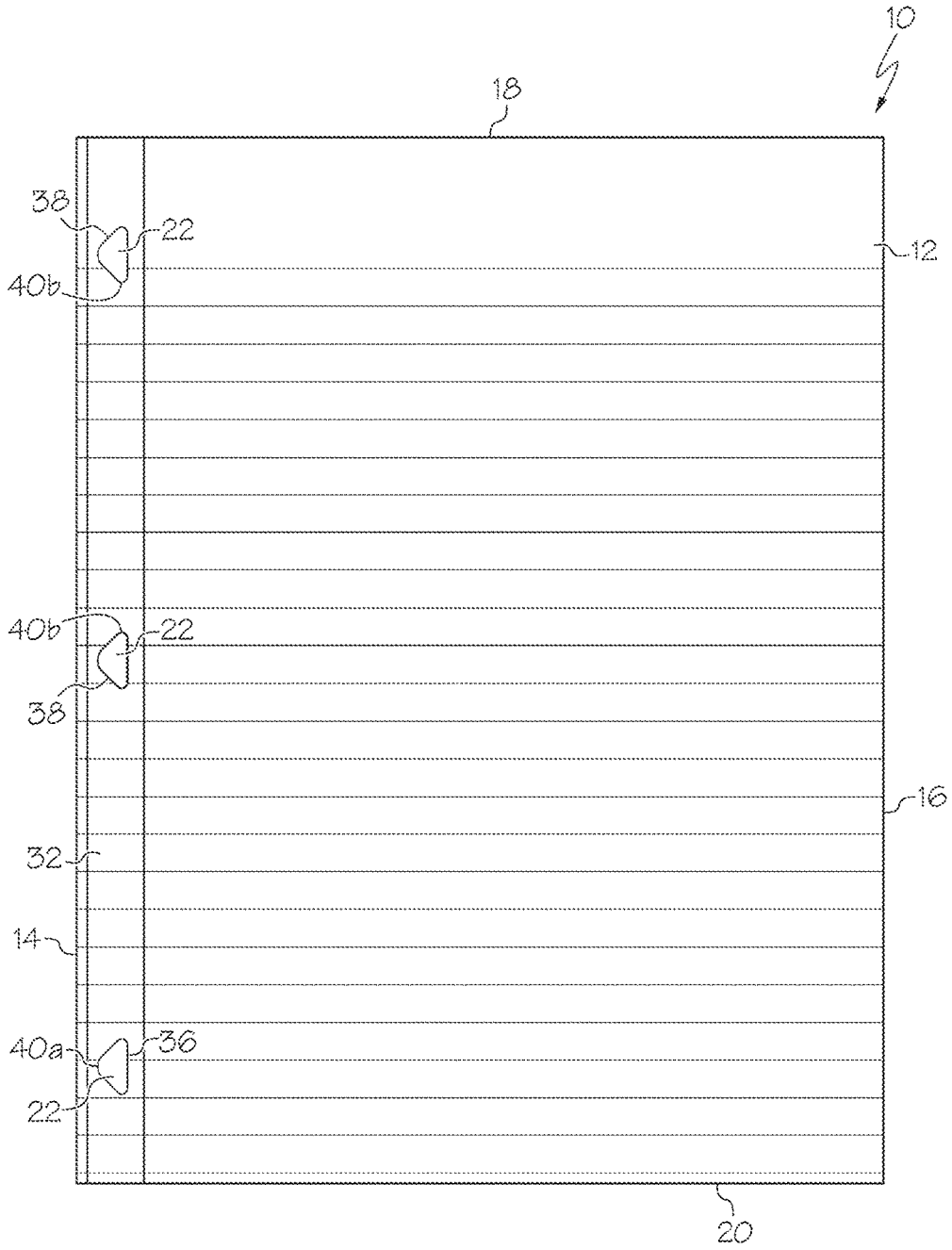
FIG. 2 is a top view of a sheet item.
Figure 3:
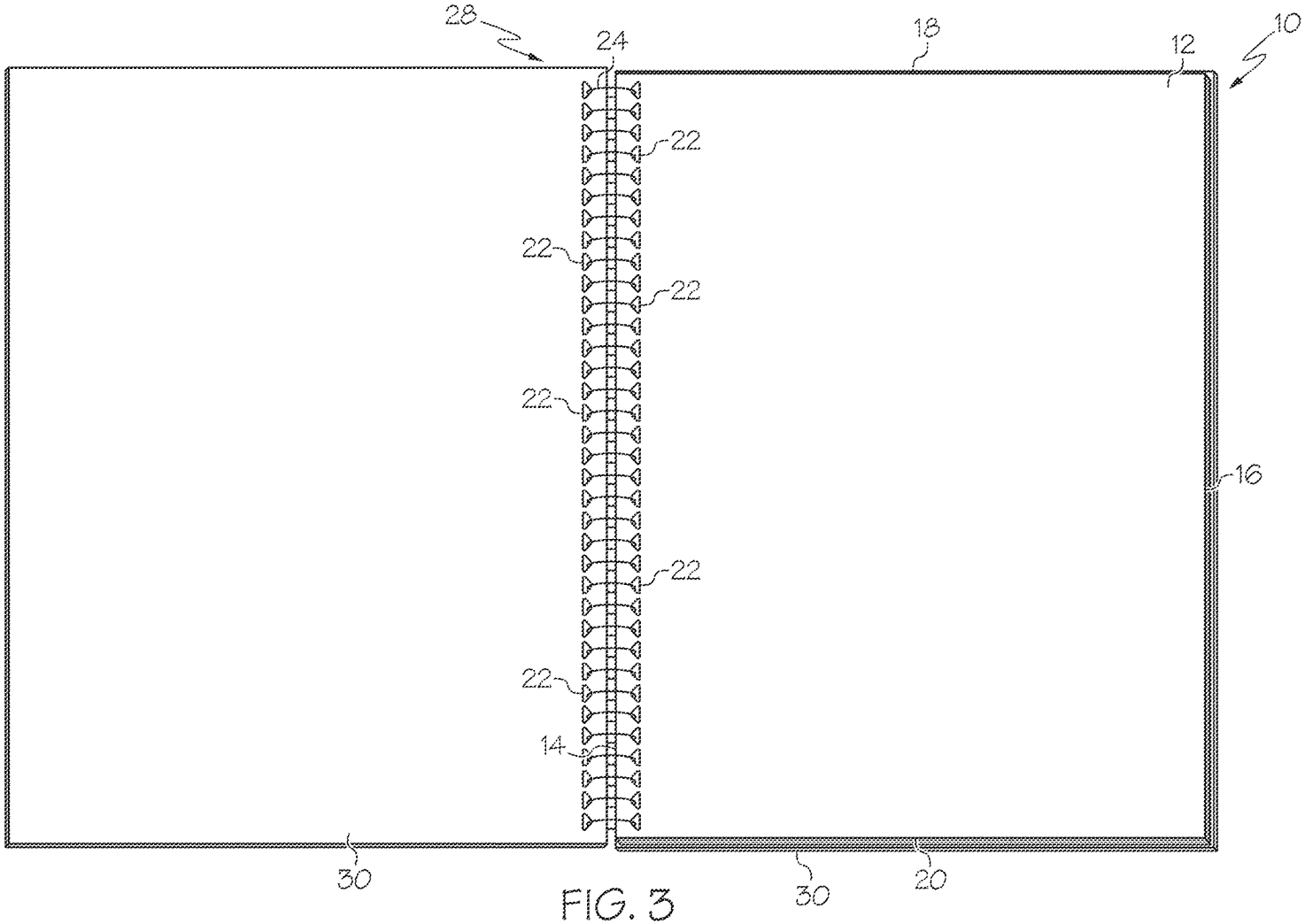
FIG. 3 is a top view of another plurality of sheet items coupled to a spiral binding.

With reference to FIGS. 1-3, in one or more embodiments a sheet system 10 of the present invention may include a sheet body, sheet item or sheet 12. In the illustrated embodiment the sheet 12 is generally rectangular and has an inner edge 14, an opposed outer edge 16, a top edge 18 and an opposed bottom edge 20 which together define an outer perimeter of the sheet 12. The sheet 12 can have any of a variety of sizes, but in one embodiment is about 8.5 inches by about 11 inches, or is A4 or A6 sized, but can be larger or smaller, and have shapes other than rectangular.

The sheet 12 can be made from a variety of materials. In one case for example the sheet 12 can be made of paper, such as writing paper, and/or nearly any material which can be written upon by a pencil, pen, marker or the like, including but not limited to fiber-based paper made from a water absorbent and/or cellulose-based or cellular based fiber pulp, synthetic materials, or a blend of pulp and synthetic materials, polymers such as plastics, etc. In one case each sheet 12 is relatively thin and flexible, and may have a thickness of less than about 0.5 mm in one case, or less than about 0.2 mm in another case, or less than about 0.1 mm in yet another case. The sheet 12 may in some cases have sufficient flexibility to fold/bend at about a 90 degree angle (fall downwardly) when the sheet 12 is gripped or secured at one end in a cantilever arrangement.

The sheet 12 can include one or more holes, openings or cut-outs 22 (collectively terms "holes" herein) formed through the sheet 12. In the illustrated embodiment, each hole 22 is positioned adjacent to an edge 14, 16, 18, 20 of the sheet 12 (the inner edge 14 in the illustrated embodiment). The sheet 12 can include a width dimension extending in a lateral direction (i.e. perpendicular to the inner edge 14) from the inner edge 14 to the outer edge 16, and in one case each hole 22 is entirely positioned a distance less than about 25% of the width of the sheet 12 from the inner edge 14, and in another case is entirely positioned a distance less than about 10% of the width of the sheet 12 from the inner edge 14. Instead of or in addition to being positioned along the inner edge 14, a hole 22 or holes 22 can be positioned along the outer edge 16, and/or upper 18 and lower edges 20, in one case with the same 25%/10% positioning with respect to a width/height of the sheet 12, or other positioning as desired.

The sheet 12 of FIG. 1 is shown bound to a binding, generally designated 24, which can bind the sheet 12 to a cover 25 and/or a plurality of other sheets 12. In the illustrated embodiment the binding 24 takes the form of a three-ring binding mechanism or the like, including one or more binding rings 26. Each binding ring 26 may be separable into two separate ring halves or portions such that sheets 12 can be placed into, or removed from, the binding 24. Each binding ring 26 may also be movable to a closed position, as shown in FIG. 1, in which the ring halves engage each other and form a closed ring to trap the sheet 12 therein. The binding 24 may be manually operable to move the binding rings 26 between the open and closed position such that the binding 24 can be manually operated to add or remove sheets 12 or other components therefrom.

In the embodiment of FIG. 1 the binding 24 includes three binding rings 26, and the sheet 12 includes three holes 22, each hole 22 having a size and location/spacing to receive one of the binding rings 26 therethrough. However, the binding 24 can include various other numbers of rings 26, such as one, two, or more than three rings 26, in which case the sheet 12 can include a corresponding number and placement of holes 22. Moreover, the binding 24 can take any of a variety of other forms or configurations besides a ring binding mechanism, and can include or take the form of a coil or wire binding (including spiral/coil/helical and twin-wire bindings), clips, cords, ribbons, clamps, prongs, posts, etc., and combinations thereof. In these cases, the holes 22 can be shaped and sized accordingly to correspond to the binding 24.

FIG. 3 illustrates a case where a coil or wire binding 24 is utilized in conjunction with a notebook 28, and the holes 22 are smaller, have a smaller spacing and are more numerous than those shown in the sheet 12 of FIG. 1. In addition, the sheets 12 are permanently bound to the binding 24 in that the sheets 12 cannot be practically removed except by tearing or destruction of the sheets 12. The notebook 28 of FIG. 3 can have a cover 30 having at least one of a thickness or stiffness greater than the sheets 12. In the illustrated embodiment the cover 30 has holes 22 with the same configuration as the sheets 12 or as otherwise described herein, although if desired the cover 30 can have holes 22 with a standard circular shape or other shapes.

FIG. 2 illustrates a sheet 12 with a reinforcing strip or reinforcing material 32 extending the entire height of the sheet 12. Each hole 22 is positioned in the illustrated reinforcing strip 32 such that the reinforcing strip 32 extends around, and surrounds the entire perimeter of, each hole 22. The reinforcing strip 32 can be made of a variety of materials, including polymer or plastic films such as PET polyester with a heat activated adhesive coating on one side. The reinforcing strip 32 can be made of a transparent or translucent material, as shown, but may also be opaque if desired.

The reinforcing strip 32 can have a variety of thicknesses, such as between about 60 gauge and 120 gauge, and about 92 gauge in one case. The reinforcing strip 32 can be applied with an adhesive and pressed onto the sheet 12 with a roller, or applied in a liquid or plastic state and allowed to cool to secure the reinforcing strip 32 to the sheet 12. The reinforcing strip 32 can be applied before the sheet 12 is cut to size and/or the holes 22 are formed, although if desired the reinforcing strip 32 could be applied after either or both of these steps.

The reinforcing strip 32 need not necessarily extend the entire height of the sheet 12, and need not be continuous. Instead, the reinforcing "strip" or material 32 can include various discreet, spaced apart portions, with each portion being positioned adjacent to a hole 22. In addition, the reinforcing strip 32 need not extend around the entire perimeter of a hole 22, but could instead extend around only part of a hole 22, such as those portions around the hole 22 that experience the greatest deformation and/or stresses when tear-out forces are applied. In the illustrated embodiment the reinforcing strip 32 has a surface area less than the surface area of a side of the sheet 12 such that the reinforcing strip 32 does not cover all of the sheet 12. However, the reinforcing material 32 can be sized to cover all, or substantially all, of one or both sides of the sheet 12, such as when the sheet 12 is a laminated or two-ply (or three-ply or more) sheet.

Figure 4:
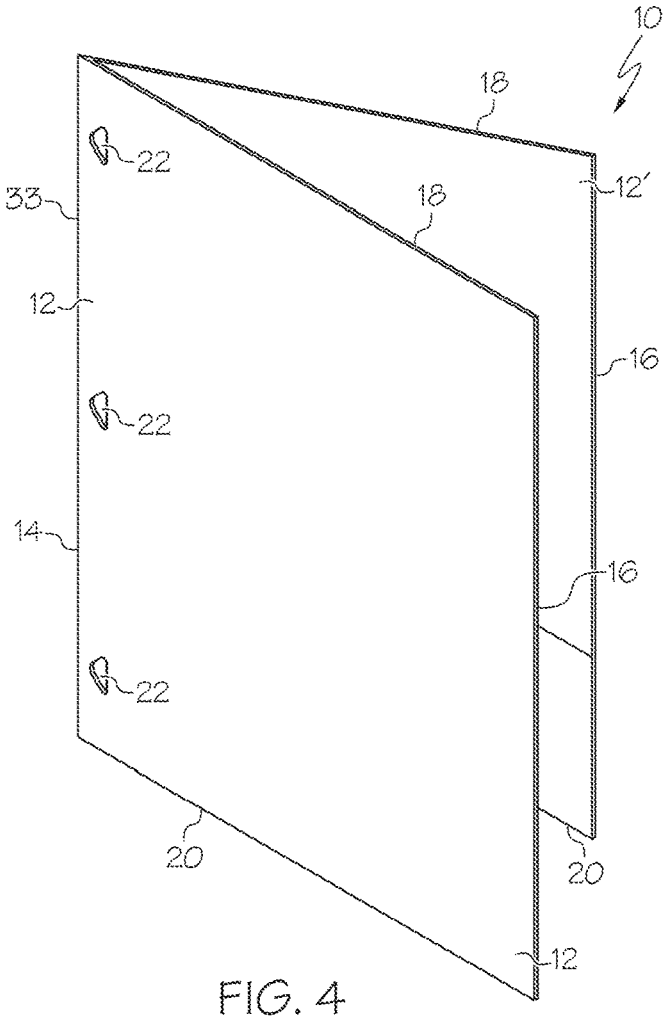
FIG. 4 is a front perspective view of a folder.

In the embodiment of FIG. 4, a sheet 12 is used in combination with another sheet 12', and pivotally coupled thereto along a spine 33 (along the inner edges 14). In this case (and/or in the case shown in FIGS. 1-3 and in other settings described herein) the sheet 12 (and sheet 12') can be relatively thick and/or stiff. Besides being made of the materials listed above for the sheet 12, the sheets 12, 12' can be made of plastics or polymer materials, including PVC, polypropylene, polyethylene, polyethylene vinyl acetate (PEVA), easy-processing polyethylene (EPPE), or other materials such as fabric, leather, cardboard, paper, polymer-covered cardboard, or polymer-covered paper (with a polymer being located on one or both sides of a paper substrate, or with paper located on both sides of a polymer substrate), etc. The sheets 12, 12' may in this case have sufficient stiffness to retain its shape when the sheets 12, 12' are secured at one end in a cantilever arrangement.

Figure 5:
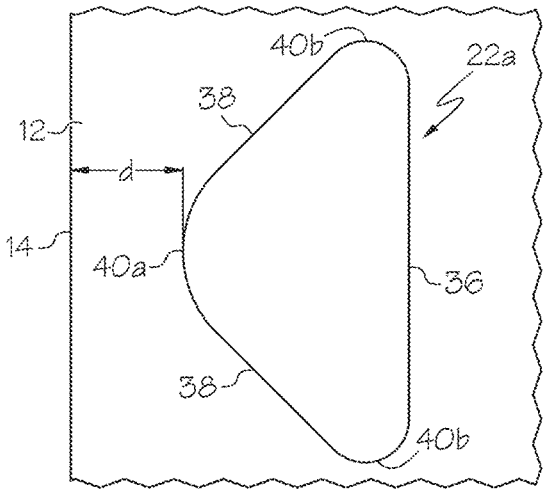
FIG. 5 is a top detail view of a hole of a sheet item of FIG. 1, 2, 3 or 4, in an unstressed configuration.

The holes 22 in FIGS. 1-4 are shown as being generally triangular shaped, shown as hole 22*a* in FIG. 5 in a detail view, but can have any of a wide variety of shapes and configurations as shown and described herein. In the illustrated embodiment, the hole 22*a* is an isosceles triangle having a base 36 and two legs 38. However the triangular shape of the holes 22*a* need not necessarily be an isosceles triangle, and can be, for example, an equilateral or scalene triangle.

The base 36 may be located away from the inner edge 14 and be parallel or generally parallel to the inner edge 14. Moreover, the base 36, rather than being a straight line, can be curved, for example, either concave or convex relative to the inner edge 14, or have other shapes, and the legs 38 may also in some cases deviate somewhat from strictly straight lines. The base 36 may be the edge or portion of the hole 22*a* furthest from the inner edge 14, and the legs 38 may be positioned between the base 36 and the inner edge 14 in a direction perpendicular to the inner edge 14.

The hole 22*a* can have three corners 40, and in the illustrated embodiment includes a vertex corner 40*a* and two opposed base corners 40*b*. The vertex corner 40*a* is positioned generally opposite the base 36. In the illustrated embodiment the vertex corner 40*a* is the edge or portion of the hole 22 closest to the inner edge 14, and the legs 38 are positioned between the vertex corner 40*a* and the base 36, in a direction perpendicular to the inner edge 14. The angle defined by each base corner 40*b* can have a variety of sizes, but may be between about 40 and about 60 degrees in one case, and about 50 degrees in one case, to ensure that stresses and deformations are distributed in the desired manner.

Each of the corners 40 of the triangle hole shape 22*a* can be curved, radiused or rounded (collectively termed "rounded" herein and wherein "rounded" does not necessarily mean the corner has a strictly circular profile). For example, each corner 40 may have a radius or average radius that is at least about 5% of a length of the base 36 (and/or legs 38 or, generally speaking, a length of any side of the triangle, or a longest side), and less than about 45% of a length of the base 36 (and/or legs 38 or, generally speaking, a length of any side of the triangle, or a longest side). Moreover, if desired, the vertex corner 40*a* may have a differing radius of curvature than the base corners 40*b*, and in one case the vertex corner 40*a* has a greater radius of curvature (or average radius of curvature) than the base corners 40*b* (or any other corners of the triangle, if the triangle is not isosceles). For example, in one case the vertex corner 40*a* has a radius or average radius that is at least about 15% of a length of the base 36 (and/or legs 38 or, generally speaking, a length of any side of the triangle, or a longest side), and less than about 45% of a length of the base 36 (and/or legs 38 or, generally speaking, a length of any side of the triangle, or a longest side). Each base corner 40*b* may have a radius or average radius that is at least about 5% of a length of the base 36 (and/or legs 38 or, generally speaking, a length of any side of the triangle, or a longest side), and less than about 20% of a length of the base 36 (and/or legs 38 or, generally speaking, a length of any side of the triangle, or a longest side).

When tear-out forces are applied to the sheet 12, the curved or radiused nature of the corners 40 avoids concentration of stresses and applied forces to minimize tearing. In addition, the vertex corner 40*a* can experience forces and/or stress applied directly thereto by the binding 26, in contrast with the base corners 40*b*. Thus, the increased curvature/radius in the vertex corner 40*a* enables the hole 22*a* to better accommodate tear-out forces.

The inner-most portion of the hole 22*a*, the vertex corner 40*a* in the illustrated embodiment, may be positioned relatively close to the inner edge 14. In particular, the distance d between the vertex corner 40*a* and the inner edge 14 may be between about 20% and about 60% of the length of the base 36 (or any other side of the triangle). This spacing provide sufficient thickness to the distance d to improve tear-out strength of the sheet 12, but is not so large as to render the hole 22 unreachable by the binding 26.

Figure 6:
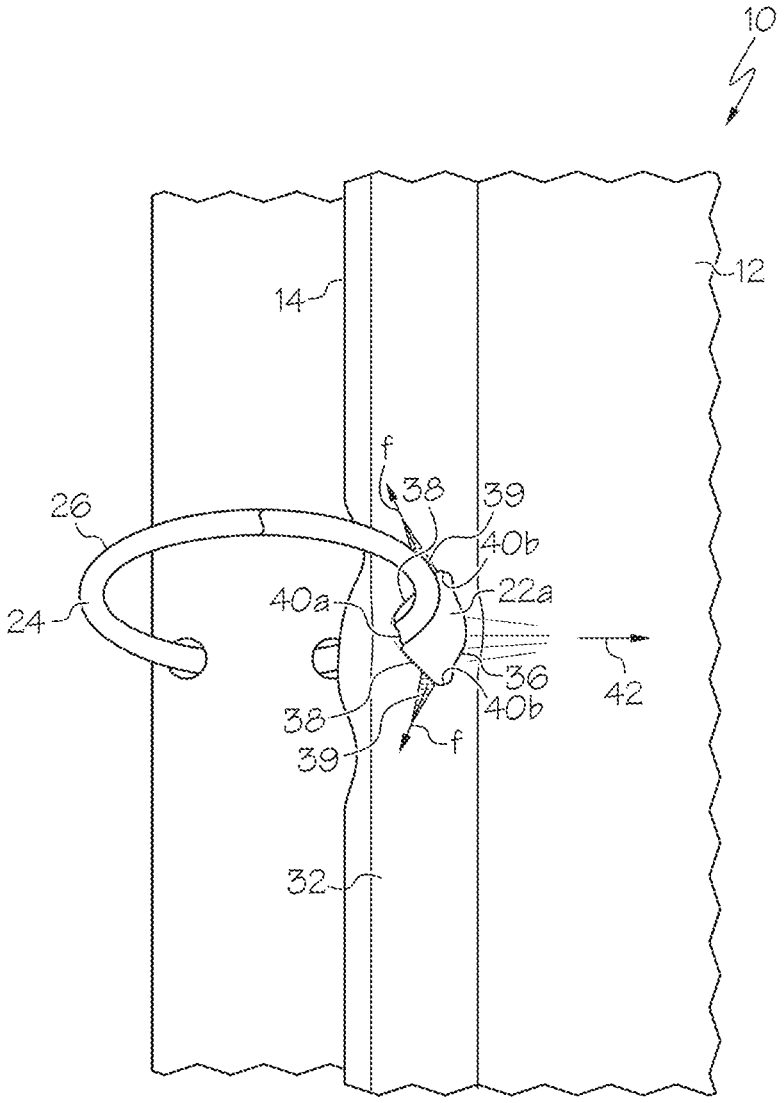
FIG. 6 is a top detail view of the hole of FIG. 5, mounted to a binding and in a stressed configuration.
Figure 7:
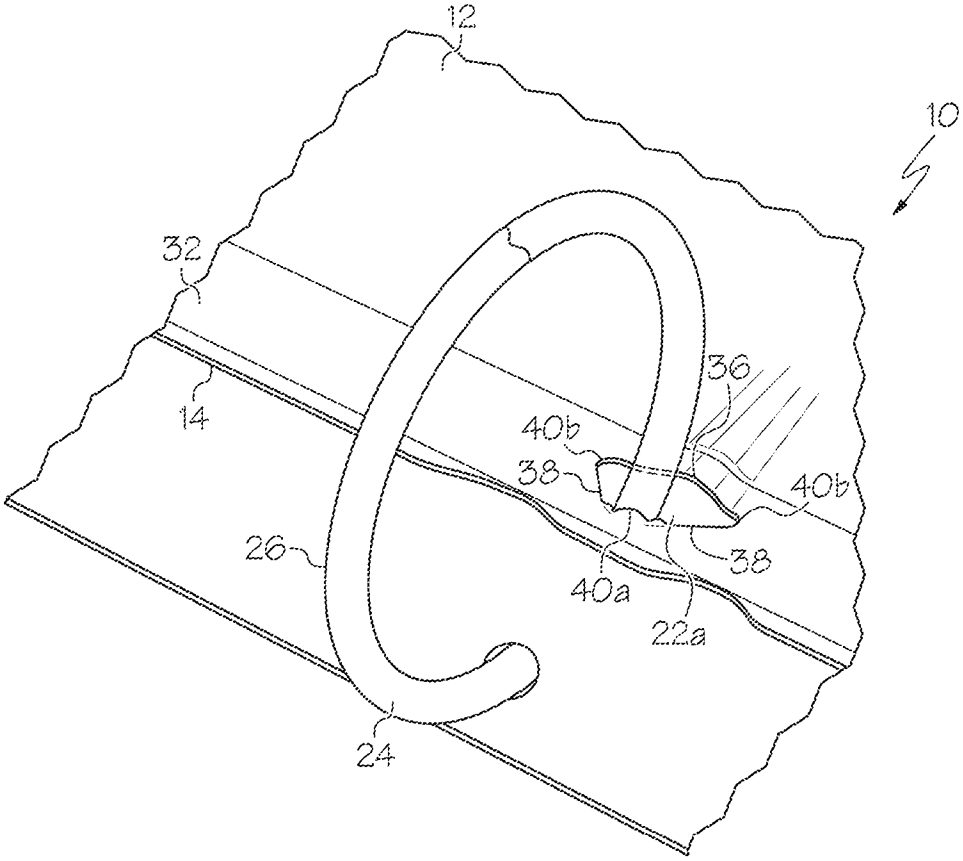
FIG. 7 is a side perspective view of the hole of FIG. 6.
Figure 8:
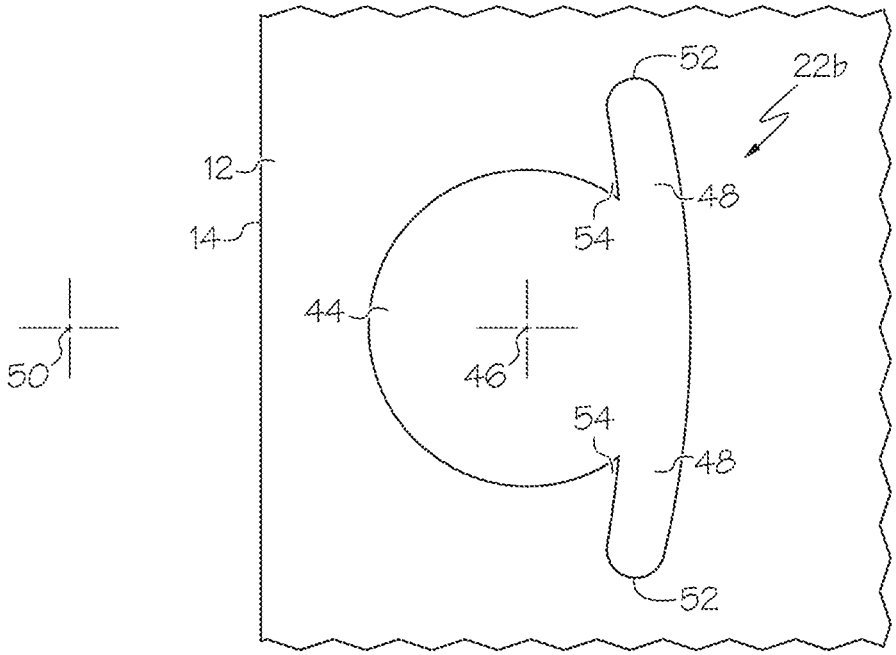
FIG. 8 is a top view of a first alternate hole shape for use with a sheet item.

The hole 22*a* is configured to resist tearing forces or tear-out forces when, for example, tearing forces are applied to the sheet 12 in the direction of arrow 42 as shown in FIGS. 1 and 6. In particular the hole 22*a* generally better disperses the applied tension into the body of the sheet 12 as compared to, for example, a circular hole. When tearing forces are applied to a sheet 12 having the hole 22*a*, the hole 22*a* is pulled out of the shape shown in FIG. 5 and the sheet 12/hole 22*a* can deform and assume the shape as shown in one case in FIGS. 6 and 7. In this case, the base 36 assumes a curved/concave shape out of the plane of the sheet 12, taking on a "hooded" appearance as best shown in FIG. 7. Rather than being strictly "hooded" the base 36 can take on a warped and/or buckled form, warping and/or buckling out of the plane of the sheet 12. The curvature/radius of the base corners 40*b* may increase, and the curvature/radius of the vertex corner 40*a* may decrease, when the hole 22*a* is stressed as shown. The curved shape of the corners 40*a*, 40*b* can minimize areas of stress concentration where tearing might occur.

As can be seen in FIGS. 6 and 7, the materials of the sheet 12 in the area of the vertex corner 40*a* can also rotate slightly and present a vertically-extending side surface of the sheet 12 to the ring 26, instead of simply an edge of the sheet 12. When the sheet 12 assumes this position the sheet 12 thereby enables stresses to be spread out over a greater surface area and/or into the sheet 12 beyond the localized point of contact. In addition, as can be seen the inner edge 14 of the sheet 14 can also buckle and/or deform, which also takes up stresses.

The greatest deformation and stresses for the hole 22*a* may be applied at or adjacent to the base corners 40*b*, and shown as applied forces f in FIG. 6. This orientation of the applied forces f helps to ensure that the maximum deformation/stresses are applied at a location distant from the inner edge 14 so that any tearing has a further distance to travel to the inner edge 14 or any other edge, and the tearing forces and not directed directly toward the edge 14. The hole 22*a* thus provides a hole shape that resists tearing and prolongs the life of the sheet 12.

The shape and deformation of the hole 22*a* can be particularly useful when the sheet 12 has or incorporates polymers and/or long chain polymer molecules. For example, if the reinforcing strip 32 is utilized as shown in FIGS. 6 and 7, when the hole 22*a* is deformed, the stressed polymer strands/molecules become aligned (in one case along the arrows f where relatively high forces are applied). In this case, the reinforcing strip 32 may deform, and its molecules become aligned, first or most prominently roughly in the area of the shaded triangles 39 shown in FIG. 6, and thereby increase in strength in those areas. This warping/deformation takes up stresses that might otherwise cause tearing, causing the highest stressed areas to occur where desired, and focusing the stresses into the plane of the sheet 12 into a "molecule-stretching" behavior. This spreads the stress out into the sheet 12, instead of being all focused directly into one undesirable area. Thus the reinforcing strip 32 can find particular utility with some or all of the hole 22 shapes disclosed herein.

In addition, the reinforcing strip 32 or material may only be located at the portions of highest stress of a hole 22—e.g. along/around the base 36 and/or corners 40*a*, 40*b* and/or in the area of the triangles 39 in the case of hole 22*a*. In some cases, rather than (or in addition to) using the reinforcing strip 32, the material of the sheet 12 can include or be made of polymers/long chain polymer molecules. For example, as outlined above the sheet 12 can be made of a cellulose-based material with polymer molecules mixed therein, or the sheet 12 can be made of entirely or mostly polymer-based material. In this case the material of the sheet 12 can be stressed and the polymer molecules aligned as outlined above. However, in all cases it should be understood that the sheet 12 need not necessarily include the reinforcing strip 32 and/or polymer materials. Instead the sheet 12 can be made of traditional cellulose-based paper materials or the like.

Applicant has had testing conducted by an outside agency upon sheets utilizing the hole shape 22*a* shown in FIGS. 1-7, with the reinforcing strip 32. The testing compared filler paper (50# offset) with holes 22 having a triangular shape as shown in FIGS. 1-7 with filler paper having holes with a circular shape, wherein both papers had reinforcing film (92 gauge tape) extending over the holes. The testing was conducted under standard TAPPI (Technical Association of the Pulp and Paper Industry) temperature and humidity conditions, with 6 or more repeats per sample. The reinforced filler paper was placed into a standard one-inch 3 ring metal binder. The binder and paper were placed into a universal testing machine which conducts standard tensile testing, subjecting a sample to controlled tension until failure. The binder-pull test measured the amount of force needed to tear the paper off of the 3 ring metal binder fixture. "Spot" testing was performed regularly to ensure performance and quality standards were maintained. Testing found that the reinforced filler paper with the triangular hole shape 22*a* had a significantly increased tear-out strength compared to reinforced filler paper with a round hole.

The holes 22 can have various other shapes besides triangular, such as eccentric and/or non-circular shapes, some of which are shown in FIGS. 8-12. The hole 22*b* shown in FIG. 8 has a generally circular body portion 44 defined by a constant radius about a body portion center 46. The body portion 44 (and/or its outer edge) extends about 250 degrees in the illustrated case, and can extend greater than about 180 degrees and less than about 360 degrees, or less than about 300 degrees in one case. However, the body 44 portion can have shapes other than strictly circular, such as oval, elliptical or the like.

The body portion 44 terminates in/communicates with a generally arcuate portion 48 taking the form of a slit having a uniform, or slightly tapering, thickness. The slit 48 can in one case take the form of a gap or material actually removed from the sheet 12, as opposed to a single cut formed in the sheet 12. Thus the arcuate portion 48 in this case is at least partially defined by at least two, spaced apart parallel arcuate edges. The arcuate portion 48 can extend between about 15 and about 45 degrees, and about 30 degrees in one case, about an arcuate portion center point 50. The center point 50 can be positioned externally of the body portion 44, and also positioned externally of the sheet 12 (e.g. outwardly of the inner edge 14) in one case. In this manner the arcuate portion 48 curves toward, and is concave relative to, the inner edge 14 and/or is generally parallel with the inner edge 14. The arcuate portion 48 can have a radius greater than a radius of the generally circular body portion 44. The distal ends of the arcuate portion 48 can have curved or radiuses tips 52.

In the illustrated embodiment the arcuate portion 48 is positioned away from the inner edge 14 such that the body portion 44 is positioned between the inner edge 14 and the arcuate portion 48. However, if desired the hole 22*b* can be rotated 180 degrees about the body portion center 46 such that the arcuate portion 48 is positioned between the inner edge 14 and the body portion 44.

The hole 22*b* is configured to resist tearing forces when, for example, tearing forces are applied to the sheet 12 in the direction of arrow 42 of FIG. 1. In particular the hole 22*b* disperses the applied tension load more broadly out into the body of the sheet 12 as compared to, for example, a circular hole. When tearing forces are applied to a sheet 12 having the hole 22*b*, the sheet 12/hole 22*b* deforms. For example, the hole 22*b* is pulled out of the shape shown in FIGS. 6 and 7 by elongating the body portion 44 in the direction of arrow 42 and shrinking the arcuate portion 48 along its length. In addition the "corners" 54 between the body portion 44 and the arcuate portion 48 tend to get pulled out of the plane of the sheet 12. This warping/deformation takes up stresses that might otherwise cause tearing. In addition, the curved nature of the body portion 44 and the curved tips 52 of the arcuate portion 48 avoid presenting areas of stress concentration where tearing might occur. In addition, the greatest deformation and stresses for the hole 22*b* are applied to the arcuate portion 48 and adjacent surfaces of the sheet 12. It is desired to apply deformation/stresses at a location distant from the inner edge 14 so that any tearing has a further distance to travel to the inner edge 14 or any other edge. The hole 22*b* thus provides a hole shape that resists tearing and prolongs the life of the sheet 12.

Figure 9:
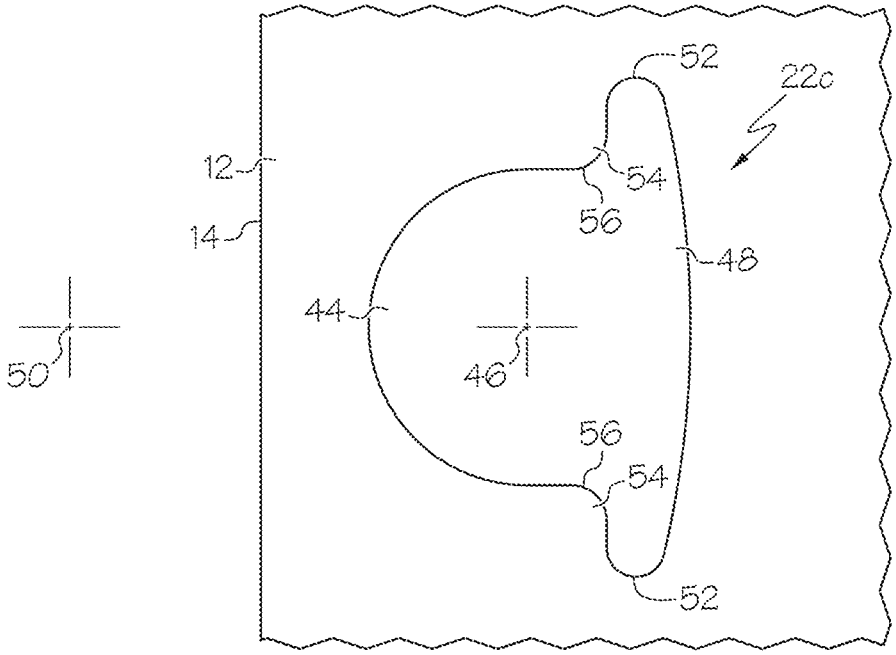
FIG. 9 is a top view of a second alternate hole shape for use with a sheet item.

FIG. 9 illustrates a hole shape 22*c* which is similar to the hole shape 22*b* outlined above. However, the hole 22*c* includes a radius or curved area 56 at the junction between the body portion 44 and the arcuate portion 48 which can further reduce areas of stress and/or provide ease of manufacturing. The hole shape 22*c* shown in FIG. 9 was tested in conjunction with paper having a reinforcing strip 32, in the same manner as the testing outlined above involving the hole 22*a*. Testing found that the reinforced filler paper with the hole shape 22*c* had a significantly increased tear-out strength compared to reinforced filler paper with a round hole.

Figure 10:
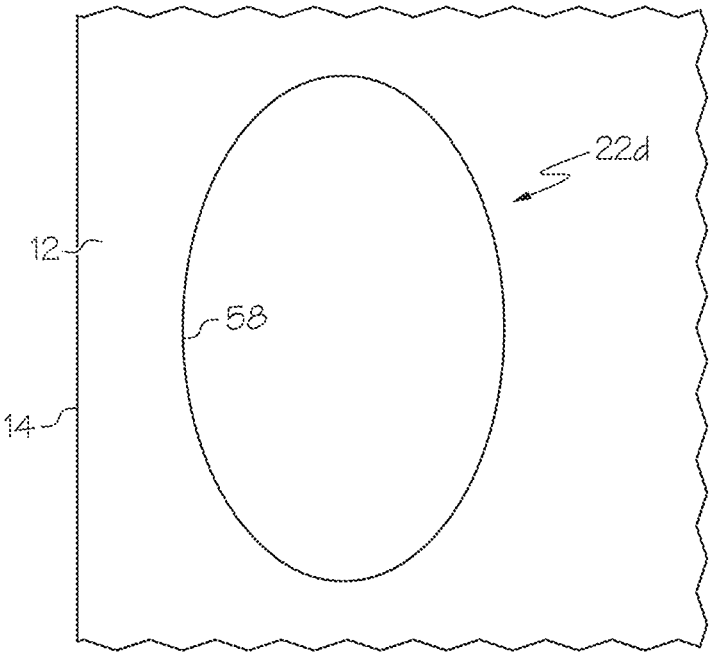
FIG. 10 is a top view of a third alternate hole shape for use with a sheet item.

FIG. 10 illustrates a further alternate hole shape 22*d* which takes the form of an oval or an ellipse. In the illustrated embodiment the hole 22*d* has a longitudinal axis extending generally parallel to the inner edge 14 of the sheet 12. In one case all of the outer edges of the hole 22*d* are curved as compared to, for example, a shape having curved (semicircular) ends joined by straight lines. The hole 22*d* can have a length-to-width ratio of at least about 1.2 in one case, or at least about 1.5 in one case, but less than about 2.5 in one case and less than about 2.0 in one case, and in one case at least about 1.4 but less than about 1.8. This range of ratios helps to ensure that stresses and deformations are distributed properly. In this embodiment, any tearing, stresses or deformation can be more prevalent in places other than the edge 58 positioned adjacent the inner edge 14 of the sheet 12, which can provides advantages similar to those of the hole shapes 22*a*, 22*b* and 22*c* outlined above.

The hole shape shown in FIG. 10 was tested in conjunction with paper having a reinforcing strip 32, in the same manner as outlined above involving the hole 22*a*. Testing found that the reinforced filler paper with the hole shape 22*d* had a significantly increased tear-out strength compared to reinforced filler paper with a round hole.

Figure 11:
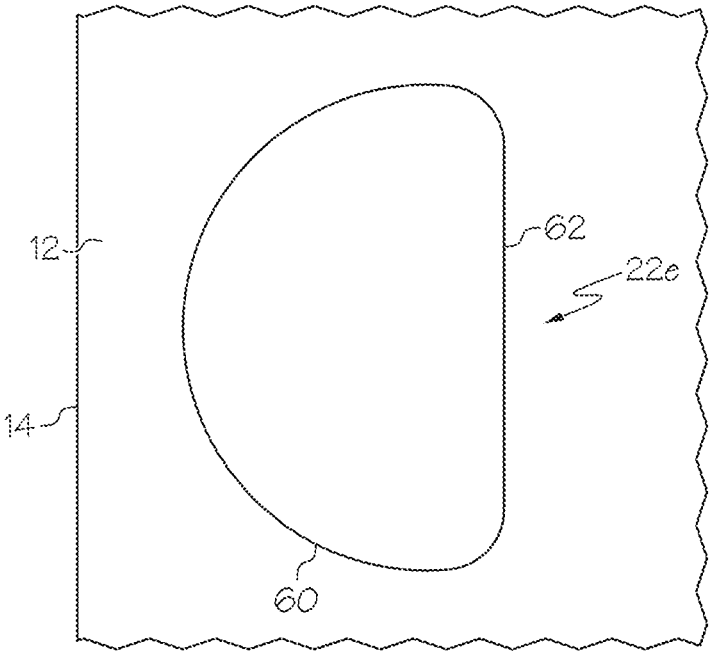
FIG. 11 is a top view of a fourth alternate hole shape for use with a sheet item.

FIG. 11 illustrates a further alternate hole 22*e* which has a generally reversed "D" shape. In particular the hole 22*e* can have a curved, circular, elliptical or oval edge 60 facing the inner edge 14, and a straight or generally straight edge 62 positioned away from the inner edge 14 such that the curved edge 60 is positioned between the straight edge 62 and the inner edge 14 of the sheet 12. The edge 62 can be parallel or generally parallel with the inner edge 14, and both of the corners of the hole shape 22*e* can be curved or radiused. Moreover, the edge 62, rather than being a straight line, can be curved, for example, either concave or convex relative to the inner edge 14, or be shapes other than straight. The curved edge 60 can have a radius that is, in one case about ½ the length of the edge 62, or between about 0.4 and about 0.6 of a length of the edge 62 in one case to ensure that stresses and deformations are distributed properly. In this embodiment, any tearing, stresses or deformation can be more prevalent in or adjacent to the edge 62 positioned away from the inner edge 14 of the sheet 12, which provides advantages similar to those of the hole shapes outlined above.

The hole shape shown in FIG. 11 was tested in conjunction with paper having a reinforcing strip 32, in the same manner as outlined above involving the hole 22*a*. Testing found that the reinforced filler paper with the hole shape 22*e* had a significantly increased tear-out strength compared to reinforced filler paper with a round hole.

Each of the holes 22*a*, 22*b*, 22*c*, 22*d* and 22*e* can take on all or some of the deformation features shown in FIGS. 6 and 7, and provide the benefits described herein. For each of holes 22*a*, 22*b*, 22*c*, 22*d* and 22*e*, each hole can have a longitudinal dimension oriented parallel to inner edge 14 of the sheet 12, wherein the longitudinal dimension extends along a greatest dimension of the hole (the vertical height of the holes 22*a*, 22*b*, 22*c*, 22*d*, 22*e* in their orientation shown in FIGS. 5 and 8-11). In one case each hole 22*a*, 22*b*, 22*c*, 22*d*, 22*e* has a longitudinal edge extending generally along the longitudinal dimension, and the hole has at least one non-longitudinal edge that does not extend generally along the longitudinal dimension, wherein the non-longitudinal edge is positioned between the longitudinal edge and the edge 14 of the sheet 12. The longitudinal dimension can be defined by a continuous edge (e.g. in one case having a curvature therealong less than 180 degrees in one case, or less than about 90 degrees in another case) positioned in an outer half of the hole 22 (e.g. wherein the outer half is in one case the half of the hole 22 positioned away from the inner edge 14).

Figure 12:
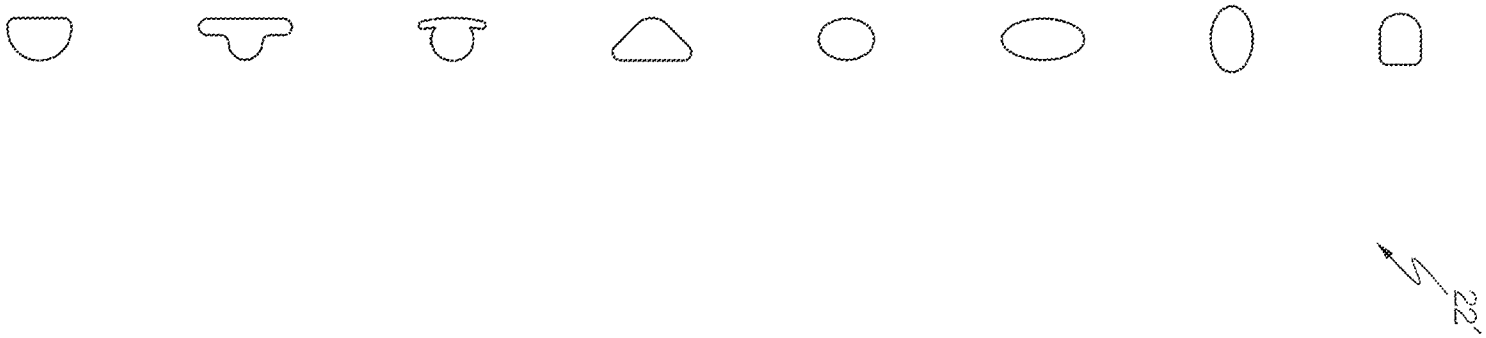
FIG. 12 is a top view of various further alternate hole shapes for use with a sheet item.

For a traditional circular hole the stress of tear-out forces are greatest at the center point of the side of the hole closest to the edge 14 contacting the binding 26 (i.e. the 9 o'clock position in the configuration shown in FIGS. 1 and 3), and there is little dispersion of the applied stress. Better performance, as compared to a circular hole, can be provided by increasing the dimension of the hole 22 in a direction parallel to the adjacent edge 14, and particularly when the larger dimension is on the side of the hole 22 opposite the edge 14. This configuration can allow the hole 22, along with areas of the sheet 12 adjacent to the hole 22, to distort/deform/become non-planar such that stresses are dispersed away from the point of contact between the hole 22 and the binding 24, providing improved tear-out strength. FIG. 12 illustrates some further alternate hole shapes 22', some of which are the same or generally the same as the hole shapes outlined above, others of which are different. It should be noted that any of the holes 22 disclosed in any of the figures or otherwise described herein can be rotated from the positions shown or described, either 90 degrees, 180 degrees or 270 degrees.

It should be understood that the holes 22 can be sized, in some cases, to generally correspond to the binder 24 received through the holes 22. Thus in one case, for example, the cross section of each ring 26 received through each hole 22 fills, or has a surface area of, at least about 50% of the surface area of the hole 22, or in another case at least about 75%, or in another case at least about 25%. Each hole 22 can be positioned entirely internally of the sheet 12 such that each hole 22 is spaced away from the outer perimeter of the sheet 12. More particularly, each hole 22 can be isolated from the outer edges/perimeter of the sheet 12 such that the hole 22 does not communicate with any hole, slit, opening or cut-out that itself directly or indirectly intersects an edge or the outer perimeter of the sheet 12. This arrangement provides a more secure mounting arrangement in which the sheets 12 can be securely bound in place.

Although FIGS. 1-4 disclose the holes 22 in sheet items 12 that take the form of sheets of paper, covers or pockets/portfolios, it should be understood that the holes 22 can be used in conjunction with nearly any sheet item or other item which is bound or binding to a binding, or which utilizes holes. For example, such sheet items can include folders, sell sheets, dividers, etc. Any of the holes disclosed and shown herein can be implemented in items in the same manner and in the various configurations as the triangular holes shown in U.S. design patent application Ser. No. 29/532,232, entitled HOLE SHAPE FOR SHEET ITEM and filed on Jul. 2, 2015, the entire contents of which are hereby incorporated by reference.

Having described the invention in detail and by reference to the various embodiments, it should be understood that modifications and variations thereof are possible without departing from the scope of the invention.

What is claimed is:

1. A sheet system comprising a sheet having an edge and at least one generally triangular, closed-sided hole positioned adjacent to but spaced apart from the edge, wherein said hole is generally shaped as an isosceles triangle having a base and two legs of a differing length than said base, wherein said base of said triangle is oriented generally parallel with said edge of said sheet, wherein said legs are interconnected by a rounded vertex corner, with said rounded vertex corner being positioned generally opposite of said base of said triangle, and wherein said base and respective ones of said legs are interconnected by rounded base corners, with said rounded vertex corner being positioned closer to said edge of said sheet than said rounded base corners.

2. The sheet system of claim 1 wherein, relative to a direction perpendicular to said edge of said sheet, said rounded vertex corner is an edge or portion of said hole positioned closest to said edge of said sheet.

3. The sheet system of claim 1 wherein each leg is generally positioned, relative to a direction perpendicular to said edge of said sheet, between said base and said edge of said sheet.

4. The sheet system of claim 1 wherein each of said vertex corner and said base corners has an average radius that is at least about 5% of a length of a longest side of the triangle, and less than 45% of a length of the longest side of the triangle.

5. The sheet system of claim 1 wherein said vertex corner of said triangle has a greater average radius of curvature than the average radius of curvature of said base corners of said triangle.

6. The sheet system of claim 1 wherein the hole is oriented such that its longest dimension is oriented parallel to said edge of said sheet.

7. The sheet system of claim 1 further comprising a reinforcing material coupled to said sheet and extending about at least part of said perimeter of said hole.

8. The sheet system of claim 7 wherein said reinforcing material is a polymer film.

9. The sheet system of claim 7 wherein said reinforcing material extends around an entirety of said perimeter of said hole.

10. The sheet system of claim 7 wherein the reinforcing material has a surface area less than a surface area of said sheet.

11. The sheet system of claim 7 wherein said reinforcing material extends an entire dimension of said sheet in a direction parallel to said edge of said sheet.

12. The sheet system of claim 1 wherein said hole is positioned entirely internally in said sheet such that said hole is entirely spaced away from an outer perimeter of said sheet and wherein said sheet lacks any slits, cuts, openings or other holes that extend between said edge and said hole.

13. The sheet system of claim 1 wherein the sheet has dimension extending perpendicular to the edge, and wherein the hole is entirely positioned a distance less than about 25% of the dimension from the edge of the sheet, and wherein the sheet has a plurality of said holes positioned adjacent to the edge and spaced along a length of the sheet in a direction parallel to the edge.

14. The sheet system of claim 1 further comprising a binding extending through the hole and binding the sheet to a plurality of other sheets.

15. The sheet system of claim 1 wherein each leg has a shorter length than said base.

16. The sheet system of claim 1 wherein said sheet is a single stand-alone sheet that lacks any binding extending through said hole.

17. The sheet system of claim 1 wherein said base extends continuously from one of said legs to the other one of said legs.

18. A sheet system comprising:

a sheet having an edge;

a reinforcing film positioned on said sheet and spaced away from said edge; and at least one generally isosceles triangular hole having a base and two legs of a differing length than said base extending through both said sheet and said film, said hole being positioned adjacent to but spaced apart from the edge, wherein a side of said triangle is oriented parallel with said edge of said sheet, wherein triangular hole includes a rounded vertex corner, with said rounded vertex corner being positioned closer to said edge of said sheet than said side that is oriented parallel with said edge of said sheet, and wherein said triangular hole includes two other rounded corners disposed father from said edge of said sheet than said rounded vertex corner.

19. The sheet system of claim 18 wherein said hole in said sheet and said hole in said film are the same size and shape.

20. The sheet system of claim 18 wherein said base of said triangle is oriented generally parallel with said edge of said sheet and wherein said legs are positioned between said base and said edge of said sheet.

21. The sheet system of claim 18 wherein said reinforcing material extends an entire dimension of said sheet in a direction parallel to said edge of said sheet.

22. A sheet system comprising:

a sheet having an edge;

a reinforcing film positioned on said sheet; and at least one hole extending through both said sheet and said film, said hole being positioned adjacent to but spaced apart from the edge, wherein the hole is non-circular and has a longest dimension, wherein said hole is oriented such that its longest dimension is oriented parallel to said edge of said sheet, wherein said hole is positioned internally in said sheet such that said hole is entirely spaced away from an outer perimeter of said sheet, wherein said at least one hole is separated from said edge by at least a portion of said film, and wherein both said sheet and said film lack any slits, cuts, openings or other holes that extend between said edge and said hole;

wherein the hole has a generally circular body portion and a generally arcuate portion, wherein said body portion is positioned between said arcuate portion and said edge of said sheet, and wherein said arcuate portion is defined by at least two, spaced apart parallel arcuate edges, and wherein said arcuate portion is concave relative to said edge of said sheet.

* * * * *